US005163236A

United States Patent [19]

Heikkilä

[11] Patent Number: 5,163,236

[45] Date of Patent: Nov. 17, 1992

[54] METHOD AND APPARATUS FOR DRYING WEBS

[75] Inventor: Pertti Heikkilä, Kyrö , Finland

[73] Assignee: Valmet Paper Machinery Inc., Finland

[21] Appl. No.: 496,411

[22] Filed: Mar. 20, 1990

[30] Foreign Application Priority Data

Mar. 21, 1989 [FI] Finland ..... 891344

[51] Int. Cl.[5] ..... F26B 13/08

[52] U.S. Cl. ..... 34/115; 34/117

[58] Field of Search ..... 34/115, 114, 117, 122, 34/123, 111

[56] References Cited

U.S. PATENT DOCUMENTS

| | | | |
|---|---|---|---|
| 4,359,828 | 11/1982 | Thomas | 34/117 X |
| 4,807,371 | 2/1989 | Wedel | 34/115 |
| 4,876,803 | 10/1989 | Wedel | 34/117 |
| 4,882,854 | 11/1989 | Wedel et al. | 34/117 |
| 4,905,380 | 3/1990 | Eskelinen et al. | 34/115 |
| 5,022,163 | 6/1991 | Ilvespaa et al. | 34/115 X |

*Primary Examiner*—Henry A. Bennet
*Attorney, Agent, or Firm*—Steinberg & Raskin

[57] ABSTRACT

A method for use in web drying apparatus, such as a drying section of a coating or paper machine which includes drying cylinders against the outer mantles of which a web to be dried is pressed in direct contact, and wherein the web is carried from one drying cylinder to the next supported on a wire which passes from a drying cylinder over an intermediate leading cyclinder where the web is carried on the outer side of the wire out of direct contact with an outer mantle of the leading cylinder, and then to the next drying cylinder, comprises the steps of maintaining a negative pressure in a pocket space defined between a pair of successive drying cylinders and the web-supporting wire for suctioning the web into contact with the wire as it runs from one drying cylinder to the intermediate leading cylinder and from the intermediate leading cylinder to the next drying cylinder, and providing the leading cylinder with a perforated outer mantle and maintaining a negative pressure within the interior of the outer mantle, to thereby render it a suction cylinder for suctioning the web into contact with the wire as the wire travels over the suction cylinder. Apparatus for use in the method includes a pocket chamber for enclosing the pocket and apparatus for maintaining negative pressures in the enclosed pocket space and interior of the leading cylinder.

32 Claims, 6 Drawing Sheets

METHOD AND APPARATUS FOR DRYING WEBS

BACKGROUND OF THE INVENTION

This invention relates generally to methods and apparatus for use in drying sections of coating machines in which one or both sides of a web have been treated with a coating agent or size, or in drying sections of paper machines. More particularly, the invention relates to web drying methods and apparatus wherein a web to be dried is pressed in direct contact against the outer mantle of a drying cylinder and then carried by a wire over a lead cylinder with the web situated on the outer side of the wire, whereupon the web is then carried by the wire to the next drying cylinder.

It is well known to use sizing and coating devices in the finishing of paper for coating one or both sides of a web with a coating agent or size. When a web is coated in this manner, the web itself becomes moist and subject to stretching.

In a coating machine, a tension or pulling force is exerted on the web as it moves through various groups of cylinders. To provide the required pulling force, the web is usually pressed against the surface of the cylinder by means of a wire. In such a case, it is common to employ either a twin-wire draw, a so-called UNO RUN (TM) draw, or a wire draw, either at the upper or lower side of the cylinder group. The cylinders are usually heated, and are occasionally cooled. It is also known in the art to employ so-called drawing-roll groups whose only function is to draw the web through the machine without any drying effect.

As the running speed of coating machines increases, a sufficient web drawing effect often cannot be obtained by means of conventional techniques since the permeability to air of coated paper is low, so that with increasing web speed, the moving surfaces produce such a high positive pressure in the nip between the cylinder and incoming web that the web begins to slip over the cylinder surface. At higher speeds, the web also begins to flutter and, in the case of an UNO RUN-(TM) draw, the web becomes detached from the wire.

The same problems discussed above also occur in multi-cylinder drying sections of paper machines. It will therefore be understood that, although the following description is in connection with an application of the invention to coating machines, the method and apparatus of the invention are also suitable for use in other applications, such as in drying sections of paper machines, to solve precisely the same problems discussed above. Furthermore, by the present invention, it is possible to reduce fluttering of the web and the possibility of detachment of the web from the wire. The invention also facilitates the threading of the web in paper machines.

In the case of UNO RUN draws, there is a movement towards the use of cylinder groups in which the cylinders that are in contact with a wire are perforated suction rolls. In such cylinder groups, the cylinders can be situated in horizontal rows, or in vertical stacks, or in combinations of the same.

SUMMARY OF THE INVENTION

The object of the present invention is to provide new and improved methods and apparatus for drying webs in coating machines, paper machines and the like.

Another object of the present invention is to provide new and improved methods and apparatus in a drawing group or drying group of a paper machine or in a web coating machine by which the web draw capacity of the group is increased, while at the same time, fluttering of the web at high speeds is reduced.

Briefly, in accordance with the method of the present invention, these and other objects are attained by a method including the steps of suctioning the web against the web-carrying wire as the wire departs from the drying cylinder by providing a negative pressure in the pocket space formed between the drying cylinders and the wire, using suction cylinders having perforated mantles for lead cylinders which guide the web-carrying wire towards the next successive drying cylinder, i.e., providing a negative pressure in the interior of a perforated cylinder mantle, by means of which the web is kept in contact with the wire as it curves over the suction cylinder, and where the web continues to be suctioned against the wire as it departs from the suction cylinder and travels toward the next drying cylinder by means of the negative pressure prevailing in the pocket space.

In accordance with the apparatus of the invention, the pocket spaces defined by the straight runs of the web-carrying wire between the drying cylinders and the lead cylinders, as well as by the free or open sector of the mantle of the lead cylinder situated between them, is substantially enclosed by a pocket chamber construction, including for example a wall arranged between adjoining drying cylinders and end plates provided at the transverse ends of the pocket space, i.e., at the operation and service sides of the coating or paper machine. A suction cylinder having a perforated mantle is used as the lead cylinder between successive drying cylinders. Means for providing a negative pressure in the enclosed pocket space and within the interior of the suction cylinder are also provided.

Preferably, the web is initially attracted into tight contact with the drawing wire over a first run from a first drying cylinder towards a following lead cylinder by means of reduced pressure maintained within the pocket chamber. This also improves the frictional contact between the lead cylinder and the incoming web-carrying wire since any air cushion which would be created in the nip formed between the incoming wire and lead cylinder will be reduced or eliminated.

The invention provides an efficient method and apparatus for use in a drawing group of a paper machine or coating machine, which operates either as a drawing group alone, or may also act as heating and/or cooling unit for the web. The web will be maintained in tight adhering contact to the carrying wire over the entire run in which the web is not in contact with the drying, drawing and/or cooling cylinders.

According to one embodiment of the invention, only a part of the width of the web may be acted upon by the negative pressure produced in a pocket chamber. For example, only the lateral areas of the web may be subjected to the reduced pressure.

DESCRIPTION OF THE DRAWINGS

A more complete appreciation of the present invention and many of the attendant advantages thereof will be readily understood by reference to the following detailed description when considered in connection with the accompanying drawings in which:

FIG. A is a schematic view of a conventional twin-wire web drying apparatus;

FIG. B is a schematic view of a conventional UNO RUN (TM) drying apparatus;

FIG. C is a schematic view of a upper-side wire draw apparatus;

FIG. D is a schematic view of a conventional group of drawing rollers used in a UNO RUN draw.

Figure 2:
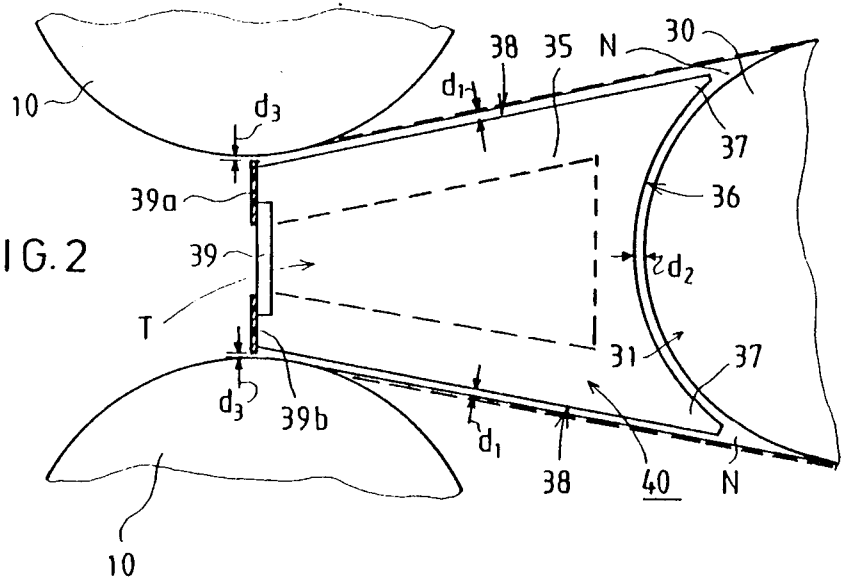
Figure 3A:
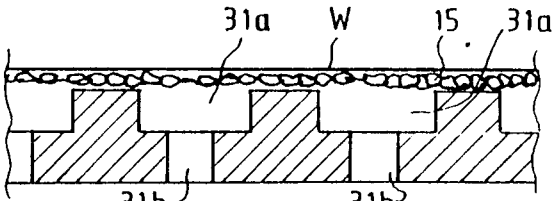
Figure 3B:
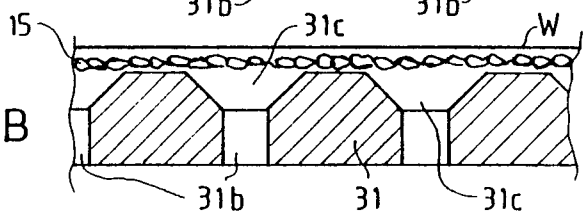
Figure 1:
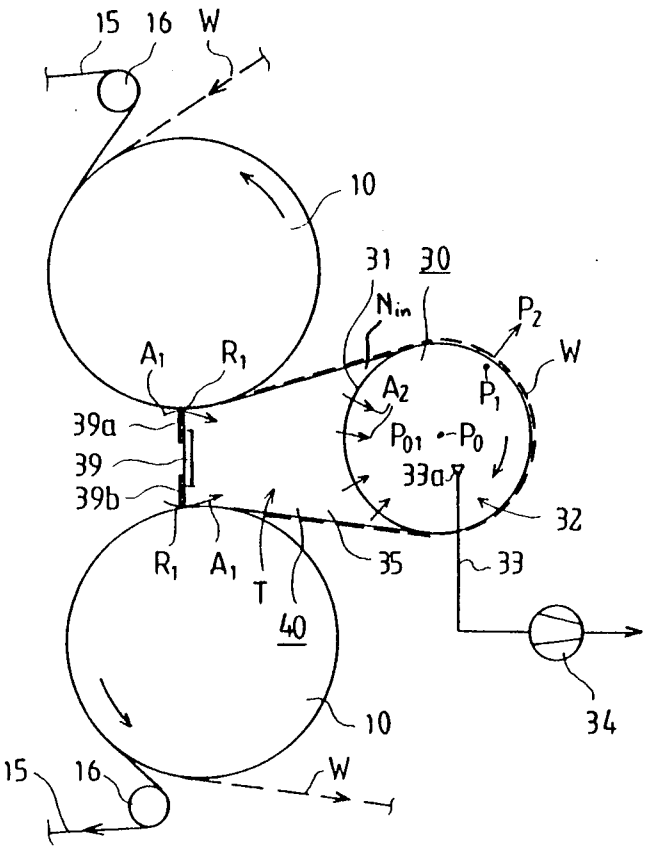
Figure 1A:
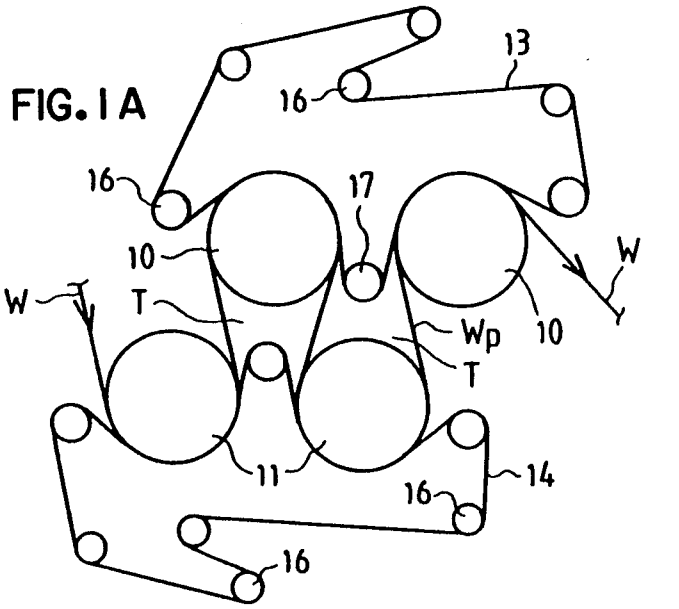
Figure 1B:
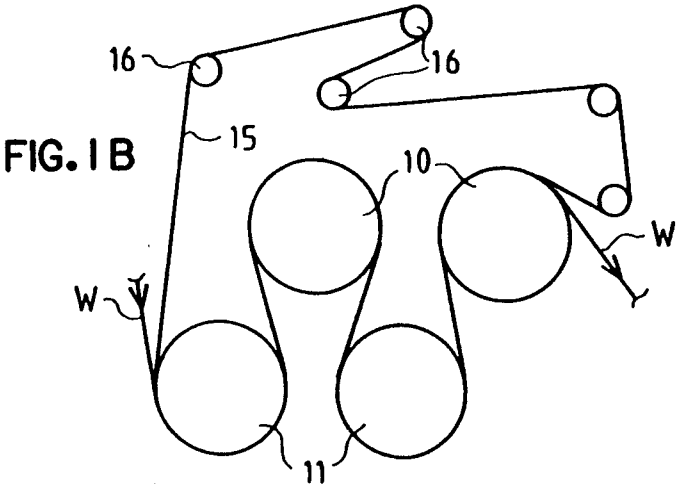
Figure 1C:
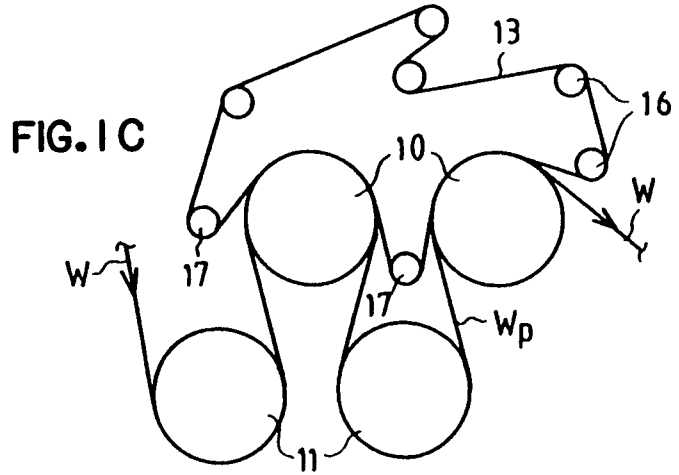
Figure 1D:
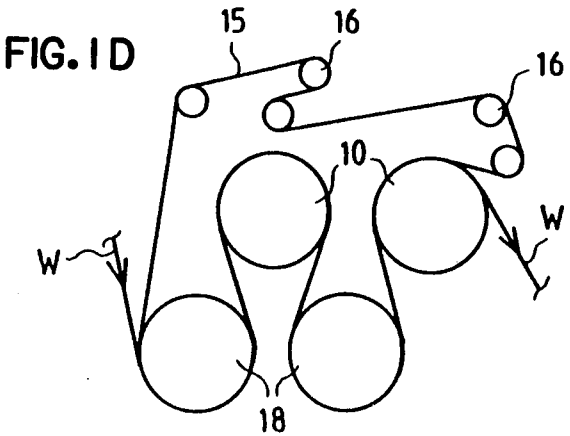
Figure 1E:
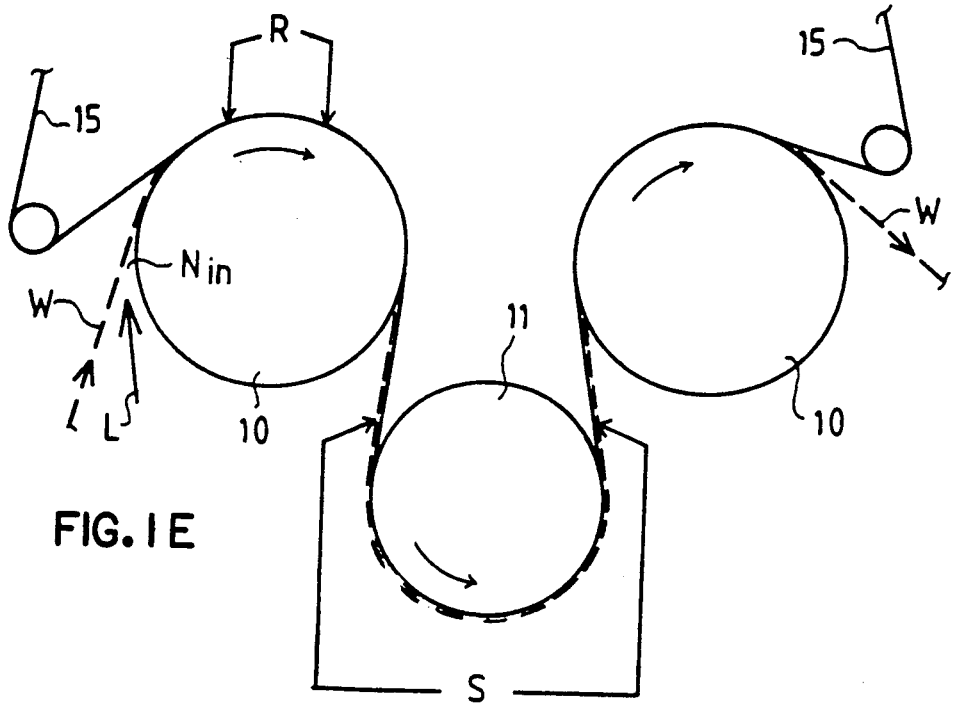
Figure 1F:
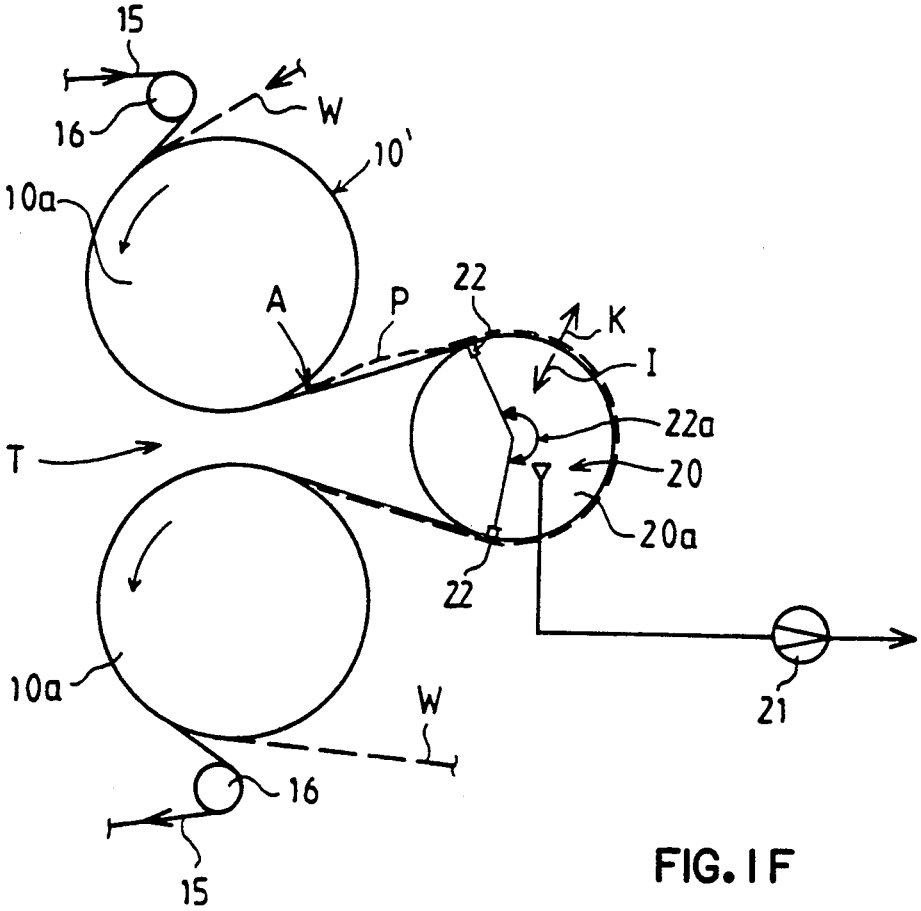
Figure 4:
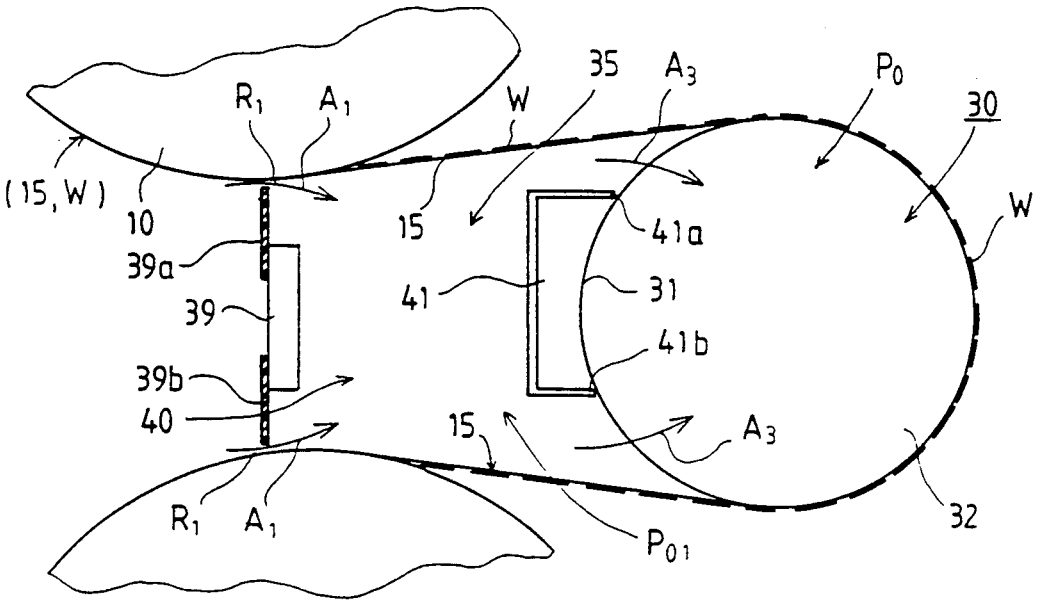
Figure 5:
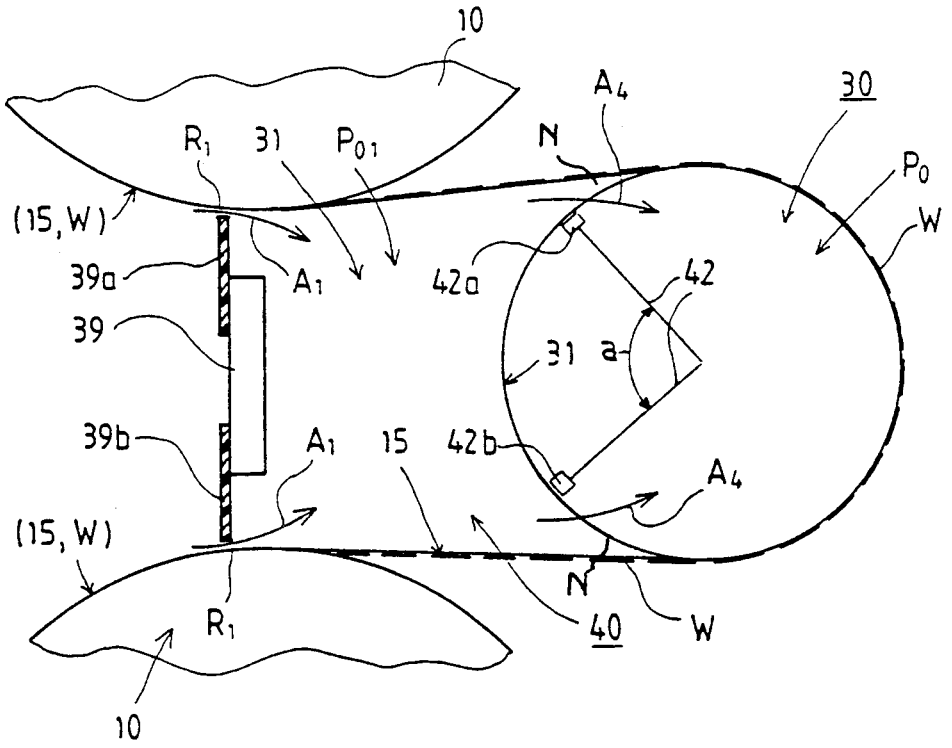
Figure 6:
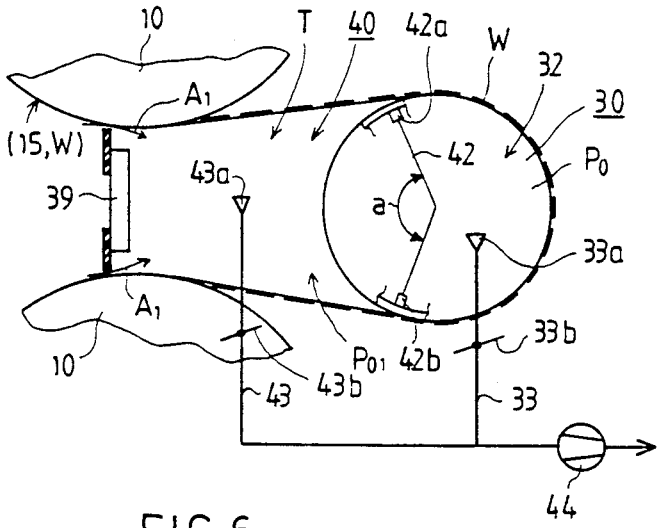
Figure 8:
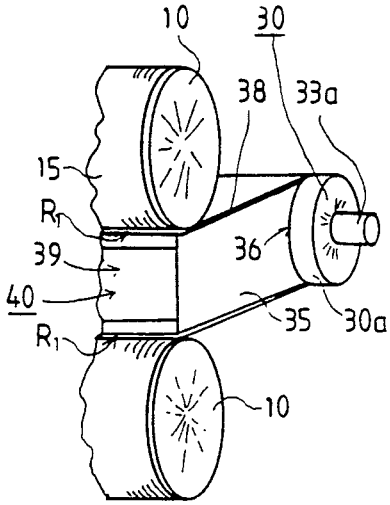
Figure 7:
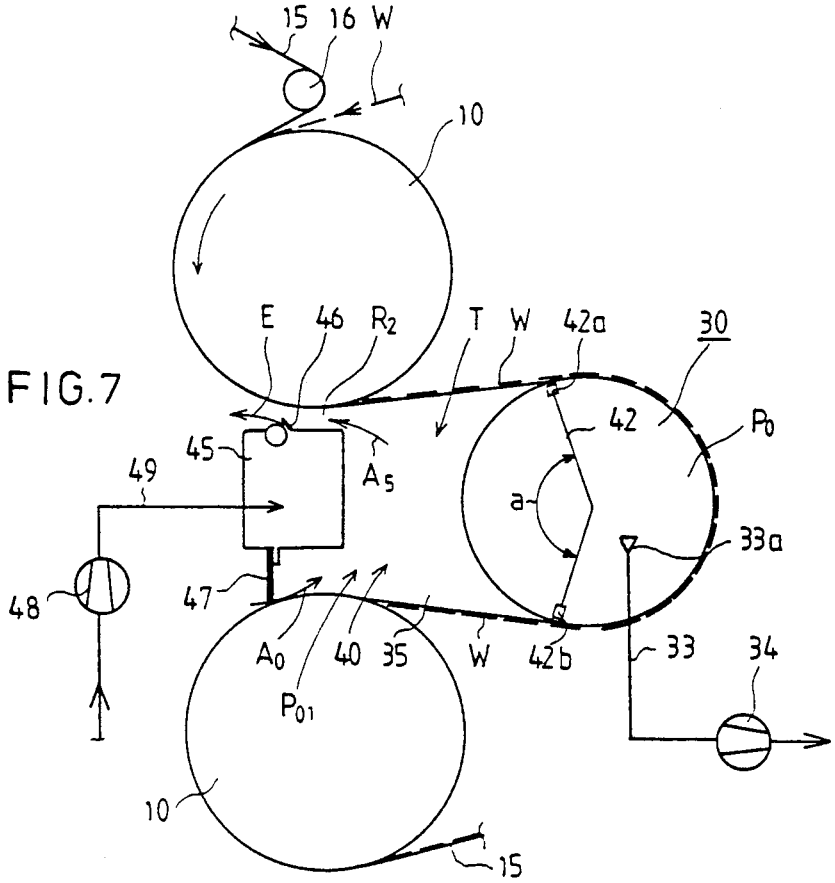
Figure 9:
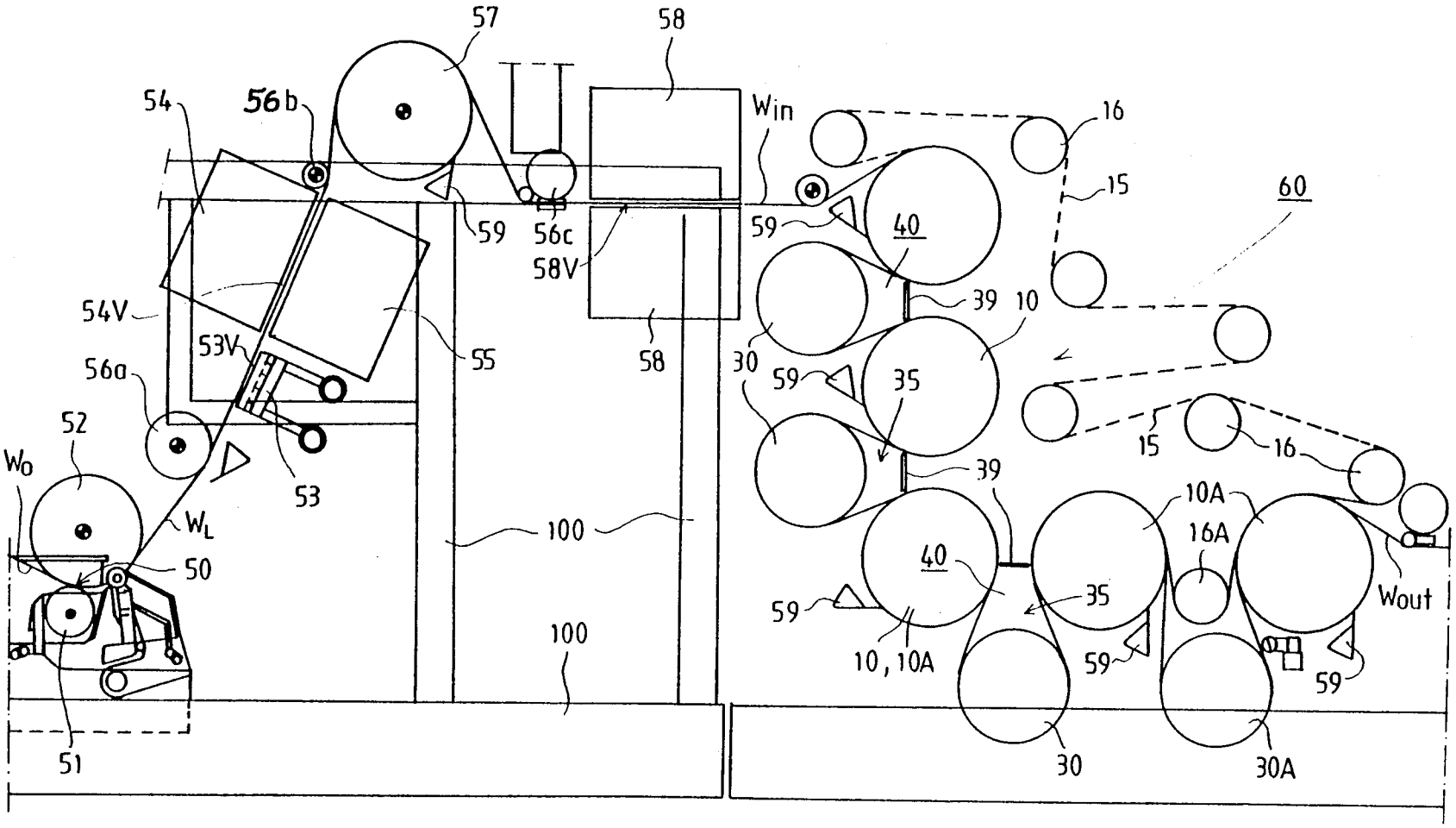

FIG. E is a schematic front view illustrating the detachment of a web from a wire in a conventional single-wire draw apparatus when a horizontal group of drying cylinders are used;

FIG. F is a schematic front view illustrating the detachment of a web from the wire in a conventional single-wire draw when a vertical group of drying cylinders are used;

FIG. 1 is a schematic side elevation view of apparatus in accordance with the invention including a plurality of vertically arranged drying cylinders;

FIG. 2 is a partial view of the cylinder group shown in FIG. 1 on an enlarged scale;

FIG. 3A is an axial sectional view of the mantle of a suction cylinder used in apparatus in accordance with the invention;

FIG. 3B is a view similar to FIG. 3A showing an alternate embodiment of the mantle of the suction cylinder;

FIG. 4 is a partial side view of an embodiment of apparatus in accordance with the invention in which the suction cylinder is partially sealed at its free or open sector that forms a boundary of the pocket space;

FIG. 5 is a partial side view of an embodiment of apparatus in accordance with the invention in which the suction cylinder is partially sealed at its free sector from the interior;

FIG. 6 is a partial side view of an embodiment of apparatus in accordance with the invention including means for regulating the negative pressure in the interior of the suction cylinder and in the enclosed pocket space, independently from each other;

FIG. 7 is a partial side view of apparatus in accordance with the invention wherein negative pressure is provided in the pocket chamber by means of a blow box situated between the drying cylinders;

FIG. 8 is a partial axonometric view illustrating one end of a pocket chamber; and FIG. 9 is a side elevation view of a coating machine in which drying apparatus and a drying method in accordance with the invention are employed.

DETAILED DESCRIPTION OF THE PREFERRED EMBODIMENTS

The prior art relevant to the present invention, and the problems inherent therein which are overcome by means of the invention, will now be discussed with reference to FIGS. A–F in which like reference characters designate identical or corresponding parts throughout the several views.

A conventional twin-wire draw drying section of a coating machine or the like is illustrated in FIG. A and includes steamheated upper and lower cylinders 10 and 11. Upper and lower wires 13 and 14 are guided in endless loops by guide rolls 16 and over sectors of the upper and lower drying cylinders by lead rolls 17 situated in the spaces between the drying cylinders. The web W has unsupported draws $W_p$ between successive drying cylinders over which the web is susceptible to flutter and breakage. The coated web W to be dried and/or cooled runs in a serpentine path from a cylinder in one row to a cylinder in another row over the open draws $W_p$. The draws $W_p$, the open sectors of the drying cylinders 10,11, i.e. the sectors not covered by web W or wires 13,14, and the runs of upper and lower wires 13,14 between the drying cylinders and the lead rolls 17 define pocket spaces T between them. The ventilation of the pocket spaces is known to be a problem in cylinder groups of this type.

A conventional UNO RUN (TM) arrangement is illustrated in FIG. B and includes steam-heated upper cylinders 10 and corresponding heated lower cylinders 11. Only a single wire 15 is employed which carries the web W from a drying cylinder in one row to a drying cylinder in the other row so that on an upper cylinder 10, the web W is in direct contact with the surface of the upper cylinder 10. On the other hand, the web W is situated on the outside of the wire 15 as the wire travels over the lower drying cylinders 11. In addition to a reduced efficiency of heat transfer between the lower drying cylinders and the web, this arrangement has the additional drawback that the web W has a tendency to become detached from the wire 15 on lower cylinders 11 due to centrifugal forces.

In the cylinder group of FIG. C, an upper wire 13 is utilized guided by guide rolls !6 and lead rolls 17. The web W is in direct contact with the surfaces of both the upper and lower drying cylinders 11. However, the web is unsupported on the lower cylinders which is a considerable drawback.

FIG. D illustrates a conventional group of drawing rolls provided with single wire draw and in which the cylinders 10,18 act solely as drawing rolls for the web and wire.

A conventional horizontal cylinder group employing a single-wire draw is illustrated in FIG. E. In this apparatus, the drying cylinders 10 comprise upper cylinders into the heated cylinder faces of which the web W enters with direct contact. An air flow is induced in the direction of the arrow L in the inlet nip $N_{in}$ between the web W and cylinder 10 and creates an air cushion in the area designated R between the web W and the surface of cylinder 10. This air cushion reduces the adhesion between the web-carrying wire and the cylinder thereby decreasing the heat transfer efficiency of the machine as a whole. Moreover the web W tends to become detached from the wire 15 in the area S of the lower cylinders 11 resulting in web fluttering and wrinkling.

A part of a prior art cylinder group is illustrated in FIG. F and includes two drying cylinders **10*a* and a lead cylinder comprising a suction cylinder 20. The cylinder group comprises a vertical stack although it is understood that the same principles are applicable to a conventional horizontal arrangement of drying cylinders. When the web W is detached from the drying cylinder 10*a* at point A, there is tendency for the web to follow the surface 10' of cylinder 10*a* rather than wire 15, whereby a so-called bag P is formed between the web W and the wire 15. When the web W arrives at the suction cylinder 20, the centrifugal force acting on it tends to pull the web W away from the suction cylinder 20, as designated by arrow K, and often causes the web W to become detached from the wire 15. Attempts have been made to prevent such web separation by providing a negative pressure in the suction zone 22*a* of the suction cylinder 20 by means of a blower 21** which tends to pull the web in the direction of arrow I.

Thus, known in the prior art (FIG. F) are cylinder groups in which suction cylinders 20 per se are utilized.

Such suction rolls require labyrinth seals 22 to be provided within the suction cylinder interior in order to confine the suction to the zone 20*a* covered by web W. Also known in the prior art is apparatus of the type shown in FIG. F which are also provided with ejector blowing means situated in the pocket space T.

Referring now to FIGS. 1–9, wherein like reference characters designate identical or corresponding parts throughout the several views, and more particularly to FIG. 1, a cylinder group in accordance with the invention is illustrated including a vertical stack of cylinders 10 and a single-wire draw provided by a wire 15 guided by lead rolls 16. The cylinders 10 may comprise drawing, cooling and/or drying cylinders. In accordance with one aspect of the invention, the lead cylinders between cylinders 10 comprise suction cylinders 30 provided with perforated mantles 31. Air is evacuated from the interior 32 of the mantle 31 of each suction cylinder 30, preferably by means of suction ducts, designated 33*a*, which communicate with the cylinder interior 32 at its axle journals by means of suction ducts 33 in which a blower 34 is provided. The blower 34 produces a negative pressure within the interior 32 of suction cylinder 30.

Referring to FIG. 3A, the mantle 31 of suction cylinder 30 is perforated by suction holes 31*b* which open into grooves 31*a* that have a rectangular cross section and which extend around the circumference of the cylinder mantle.

Referring to FIG. 3B, the circumferentially extending grooves 31*c* have outwardly diverging cross-sections instead of the rectangular shape of grooves 31*a*. By means of the grooves 31*a*, 31*c*, it is possible to enlarge the area of the outer surface of the mantle over which the suction is effective so that the web W will remain substantially wrinkle-free and in good drawing contact with the web-carrying wire 15 as the wire travels over a suction cylinder 30 with the web W carried on its outer surface. A labyrinth or other type of seal is not required within the suction cylinder 30.

In accordance with the apparatus of the invention, the pocket space T between the cylinders 10 and 30 is substantially enclosed by a chamber-like structure, generally designated 40. In particular, a planar end plate 35 is provided at each transverse end of the pocket space T, i.e., at the service and operating sides of the coating or paper machine. Referring to FIG. 2, each end plate 35 has a pair of long straight edges 38, each situated at a small gap distance $d_1$ from the straight runs of the web-carrying wire 15. A curved edge 36 conforming in shape to the curvature of the suction cylinder 30 is positioned at a small gap distance $d_2$ from the mantle of suction cylinder 30.

The curved edge 36 of each end plate 35 intersects the straight edges 38 to define tapered regions 37 (FIG. 2) which extend as deeply as possible into the nip spaces N between the wire 15 and the suction cylinder 30.

The chamber-like structure 40 enclosing the pocket space T further includes a wall 39 situated in the space between the cylinders 10 and extending transversely to the machine direction as best seen in FIG. 8. Sealing elements 39*a* and 39*b* are adjustably connected to respective transverse edges of the wall 39 and are spaced a small gap distance $d_3$ (FIG. 2) from the wire 15 running over cylinders 10. Thus, the pocket space T is substantially enclosed by the straight runs of the web-carrying wire 15 and the pocket chamber 40 including the two end plates 35, the free or open sector of the suction roll 30, and the wall and sealing means 39, 39*a*, 39*b*. By "free sector" of suction cylinder 30 is meant the sector of the mantle not covered by the web-carrying wire 15.

The end plates 35 of the pocket chamber 40 are preferably removable by means of fast couplings and/or screw connections in order to facilitate cleaning and servicing. Elastic seals made of resilient material, e.g., felt or rubber, may also be provided at the edges 36 and 38 of the end plates 35. It is not necessary for such seals to contact the wire 15. For example, the gaps $d_1$, $d_2$ and $d_3$ may typically be in the range of between about 5 to 15 millimeters. The seals 39*a* and 39*b* of wall means 39 are adjustably positionable so that the magnitude of the gaps $d_3$ can be adjusted as desired for the purpose of regulating the amount of air passing into the enclosed pocket space defined by pocket chamber 40, designated by arrows $A_1$.

Both the negative pressure $P_0$ prevailing in the interior 32 of suction cylinder 30, and the negative pressure $P_{01}$ prevailing within the enclosed pocket space 40 are adjustable independently of each other. However, it is advantageous that the negative pressure $P_0$ always be maintained higher than the negative pressure $P_{01}$. This may be accomplished by increasing the amount of air evacuated from the suction cylinder. On the other hand, the negative pressure within the enclosed pocket space 40 can be increased by reducing the amount of air passing into the space 40, designated by arrows $A_1$ throughout several of the views.

Referring to FIGS. 1–3, the evacuation of air from the interior of suction cylinder 30 effected by blower 34 through ducts 33, 33*a*, causes air to flow from the interior of the enclosed pocket chamber 40 into the interior 34 of suction cylinder 30 as shown by arrows $A_2$. In this manner, the suction generated by blower 34 maintains the negative pressure in both the interior 32 of the suction cylinder 30, as well as in the enclosed pocket chamber 40. By means of the negative pressures $P_0$ and $P_{01}$, the web W is simply and sufficiently maintained in secure contact with the wire 15 over all of the distance on which the web W is not in contact with the drying cylinders, and an efficient drying contact is thereby obtained.

The size and number of the perforations in the mantles 31 of suction cylinders 30 are chosen so that the speed of the air in the perforations 31*b* is suitable, for example, in the range of between about 30 to 50 meters per second. In a typical construction, the negative pressure in the interior of the suction cylinders 30 will be in the range of between about 450 and 1,250 Pa higher than in the pocket chambers 40. The area through which air can flow from the outside environment into the enclosed pocket spaces T (arrows $A_1$) is chosen so that the air speed is in the range of between about 15 to 35 meters per second, in which case the negative pressure maintained in the chamber 40 enclosing pocket spaces T is in the range of between about 100 to 600 Pa.

Referring now to FIG. 4, another embodiment of apparatus in accordance with the invention is illustrated. The free sector of the perforated mantle 31 of the suction cylinder 30 that normally opens in its entirety into the interior of the enclosed pocket chamber 40 is partially closed and sealed by means of a covering plate 41 whose edges 41*a* and 41*b* are situated at a small gap distance from the outer surface of the cylinder 30. In this manner, throttled air flows $A_3$ pass from the interior of the enclosed pocket chamber 40 into the interior 32 of the suction cylinder 30.

Referring now to FIG. 5, a variation of the embodiment of the invention corresponding to that of FIG. 4 is illustrated. A closing chamber 42 is provided within suction cylinder 30 having seal ribs 42*a* and 42*b* at its edges that bear against the smooth inner surface of the mantle 31 of cylinder 30 so that a closed sector a of the normally open free sector is formed. In this case, limited suction flows $A_4$ flow from the interior of the chamber enclosing pocket space T into the interior 32 of cylinder 30. By choosing the magnitude of the sector a appropriately, the flows $A_4$ and, consequently, the pressure levels $P_0$ and $P_{01}$ can be adjusted appropriately with respect to each other.

An embodiment of the invention is illustrated in FIG. 6 in which substantially the entire free sector a of the mantle 31 of cylinder 30 is closed by means of a sealing arrangement 42 including seal ribs 42*a*, 42*b*. A separate suction duct 43*a* is provided within the enclosed pocket space T which communicates with the suction side of blower 44 through a duct 43 in which a regulating damper 43*b* is provided. The suction side of blower 44 also communicates with the interior 32 of suction cylinder 30 through duct 33, in which a damper 33*b* is provided, and suction duct 33*a*. By regulating the operation of blower 44, as well as independently regulating dampers 33*b* and 43*b* and, if necessary, the rate of the air flows $A_1$, the pressure levels $P_0$ and $P_{01}$ can be adjusted both independently with respect to their magnitudes, as well as relative to each other.

An embodiment of the invention is illustrated in FIG. 7 in which the level of negative pressure maintained in the enclosed pocket space T is maintained by means of an ejection blowing E from a blow box 45. Referring to FIG. 7, the normally open sector a of suction cylinder 30 is substantially entirely closed by interior sealing assembly 42, 42*a*, 42*b*. An appropriate level of negative pressure $P_0$ is obtained in the interior 32 of cylinder 30 by means of blower 34 connected to suction duct 33*a* by duct 33. On the other hand, the negative pressure $P_{01}$ is provided in the pocket space T by situating a blow box 45 at or in lieu of the wall 39 between the drying cylinders 10. A nozzle 46 in the blow box faces a gap space $R_2$ into which ejection air jets E are directed from the nozzle in a direction opposite to the direction of movement of the cylinder 10 and the drawing wire 15 by means of a blower 48 connected to the blow box 45 by duct 49. The air jets E induce an ejection of air, designated by air flows $A_5$, from the interior of the enclosed pocket space T. On the side of the blow box 45 opposite from the ejection nozzle 46, an elastic sealing web 47 is provided to reduce leakage flow $A_0$ into the enclosed pocket space as much as possible. The chamber 40 is thus formed by end plates 35, the web-carrying wire 15, the blow box 45 and sealing web 47. In other respects, the construction illustrated in FIG. 7 is similar to that described above.

A construction of the pocket chamber 40 is illustrated in FIG. 8. The chamber 40 essentially comprises a box having vertical end plates 35 at the service and operation sides of the machine, and a transversely extending wall 39 situated between the end plates 35 within the space between the cylinders 10. A suction duct 33*a* communicating with the interior of cylinder 30 is illustrated in FIG. 8. It is also noted that the perforations 31*b* in the mantle 31 of suction cylinder 30 are provided only over the portion of the mantle over which the web-carrying wire 15 runs, so that the end areas 30*a* of cylinder 30 situated outwardly of the end plates 35 are solid and not perforated.

By way of summary, an essential feature of the invention is that the negative pressure prevailing in an enclosed pocket space T attracts the web W into efficient drawing contact with the drying and drawing wire 15 after the wire 15 and web have separated from the drying cylinder 10 and move over a straight run towards the suction cylinder 30. On the suction cylinder 30, an efficient drawing contact is produced between the drying and drawing wire 15 and the surface of mantle 31 of cylinder 30 under the effect of the negative pressure that prevails within the suction cylinder 30. Additionally, a good adhesion of the web to the wire 15 is also obtained. Moreover, the good adhesion between the web and the wire 15 is further maintained when the web W and the wire 15 are transferred from the suction cylinder 30 to the next drying cylinder 10 by means of the negative pressure prevailing within the enclosed pocket space T. In the general application of the method and apparatus of the invention, it is preferable for the suction cylinders 30 to constitute the driving machine members for drawing the wire 15 over the drying cylinders.

The negatively pressurized hollow-faced mantles 31 of the suction cylinders 30 prevent formation of air cushions (see FIG. E at R) between the suction cylinders 30 and wires 15 when the suction cylinders 30 operate as the drawing members. In certain embodiments of the invention, air is efficiently suctioned from the inlet nips $N_{in}$ between the suction cylinder 30 and the wire 15 by throttling the air flows from the enclosed pocket space T into the interior of the suction cylinders as described above to enhance the suction in those areas designated by arrows $A_3$ in FIG. 4, and $A_4$ in FIG. 5.

EXAMPLE

In an example of the invention having a construction similar to that illustrated in FIG. 2, the suction cylinder 30 comprises a perforated roll from which air is evacuated from one or both of its axial ends. The size and number of perforations are chosen so that when air flows from the enclosed pocket space T into the cylinder 30, a pressure loss of a certain magnitude occurs in the perforations 31*b*. A relatively high negative pressure $P_0$, in the range of between about 500 to 1000 Pa, can be maintained in the interior 32 of the suction cylinder 30, while a lower negative pressure $P_{01}$, in the range of between about 100 to 150 Pa, can be maintained in the chamber 40 enclosing pocket space T. The pocket chamber 40 is in sealed relationship with the cylinders 30 and wire 15 by means of resilient sealing elements formed of material such, for example, as rubber, plastic, felt or the like, which yields when necessary. The gaps between the sealing elements and the moving surfaces are preferably in the range of between about 5 to 15 millimeters. When air flows from the external environment into the enclosed pocket chamber 40 and then from the pocket space into the interior of cylinder 30, a lower negative pressure will be maintained in the pocket chamber 40, while a higher negative pressure will be maintained within the suction cylinder 30. Furthermore, it is possible to regulate both of these negative pressures. In particular, the negative pressure $P_0$ in the interior 30 of suction cylinder 30 can be regulated by adjusting the amount of air being suctioned. The negative pressure $P_{01}$ in the enclosed pocket space chamber 40 can be regulated by changing the distance between the seals 39 and/or 39*b* and the cylinders 10.

An example of is calculated with its following values:

- web speed, $c=1500$ m/min$=25$ m/s
- dry grammage, $Mk=81$ g of dry solids per $m^2$
- web moisture, $u=10\%$
- wet grammage, $Mm=90$ g/$m^2$
- diameter of suction cylinder 30, $D=1100$ mm
- percentage of holes in mantle 31 of suction cylinder 30, $f=1.0\%$
- air density, $r=1.0$ kg/$m^3$.

The pressure caused by the centrifugal force pulling the web W apart from the cylinder 30 (FIG. 1) is $P_2=90/1000\times25\times0.55=102$ Pa. It was desired that the suction pressure be 500 Pa, so that the negative pressure required to act on the circumference of the suction cylinder 30 was $P_1=500+102$ Pa$=$602 Pa.

Since air revolves inside the cylinder 30, the negative pressure in the center of the cylinder 30 is $P_0=P_1+1.0\times25\ \times25$ Pa$=1227$ Pa. At the suction opening of the cylinder 30, the negative pressure is between $P_0$ and $P_1$. The negative pressure desired in the enclosed pocket space $40=100$ Pa, in which case the difference in pressure across the perforations 31*b* in the suction roll mantle is $dp=602-100$ Pa$=502$ Pa.

In such a case, the air flow speed in the perforations 31*b* is $w=(2\times502\ /\ 1.0)\ *0.5=31.7$ m/s.

When about 50% of the mantle 31 of the suction cylinder 30 is open to the enclosed pocket space 40, the amount of suction air per meter of width is:

$V/B=3.14\times1.1\times0.5\times0.01\times31.7=0.55$ $m^3/m/s=1972$ $m^3/m/h$.

When a negative pressure of 100 Pa is desired in the enclosed pocket space 40, the air velocity from the environment into the pocket is 14.1 m/s. In such a case, the flow area required per meter of width is $A=0.55/14.1=0.0039$ $m^2$.

As it can be calculated that the proportion of the ends 35 is about ⅓, the gap between the sealing and the cylinder 30 is $d_2=0.039/3=13$ mm.

If it is desired to change the negative pressure in the enclosed pocket space, it is a simple matter to change the length of the gap between the sealing at edge 36 and the cylinder 30. Generally, any manner of varying the amount of air in the enclosed pocket can be used. If it is desired to vary the negative pressure in the cylinder 30, the suction from the cylinder can be either increased or reduced.

Although the enclosed pocket space of the invention disclosed herein extends across the entire width of the web W, it will be understood that this invention has application in arrangements in which the negative pressure extends over only a part of the width of the web. For example, any of the illustrated embodiments can be easily modified so that a negative pressure extends only over both of the lateral areas of the web. In such a case, a separate pocket chamber 40 is provided at each lateral region and the suction cylinders may have perforated areas only in the lateral areas of the web communicating with chambers 40. The invention also includes applications in which a chamber 40 extending across the entire width of the web W is provided with internal partition walls. Another modification within the scope of the invention is to provide perforations only in certain areas of the suction cylinder mantles 31, or form the perforations of different sizes at different regions. Another possible modification is to provide the suction cylinders with internal partition walls which divide the suction cylinder into compartments. By any one of these arrangements, possibly among others, the level of negative pressure can be regulated in the transverse direction of the web. For example, the above techniques, possibly among others, can be used to provide a higher level of negative pressure in the lateral areas of the web W than in the middle area of the web.

Referring now to FIG. 9, a coating machine is illustrated in which an embodiment of apparatus in accordance with the invention for performing a method in accordance with the invention is incorporated. The coating machine, which may be either an on-machine device directly connected to a paper machine, or a separate finishing device, comprises a frame 100 on which rolls 51 and 52 are mounted which form a coating nip 50. A device for applying a coating agent or size is provided to cooperate with roll 51 in a known manner. The web $W_L$ which has been treated with coating agent on one or both of its sides and which has therefore become moist, and therefore prone to stretch, is passed over a roll 56*a* which cools the side of the web treated with coating agent, whereupon the web passes to a gas-infra-red dryer 53. The web $W_L$ is dried in the processing area 53 V of dryer 53 by means of infra-red radiation without contact with any heating element, whereupon the web $W_L$ is passed into the processing gap 54 V of an airborne-web dryer 55. Here, the web $W_L$ is dried in a contact-free manner by means of air jets. The airborne-web dryer 55 is followed by a guide roll 56*b* from which the web is then passed over the cylinder 57 onto a guide roll 56*c* and then onward to a second airborne web dryer 58. After passing through the processing gap 58 V of dryer 58, the web passes into the drying section 60 which is constructed in accordance with the present invention.

In particular, referring to FIG. 9, the multi-cylinder dryer 60 comprises drying cylinders 10 arranged in the manner described above, the group forming both vertical and horizontal rows of drying cylinders. Suction cylinders 30 are situated between adjacent pairs of drying cylinders 10. The interiors of the suction cylinders 30 are maintained at a negative pressure in accordance with the invention and operate as the drawing cylinders driving the web through the drying section. The pocket spaces T are enclosed in chambers 40 defined by walls 35 and 39 and are maintained at a negative pressure. The drawing and drying wire 15 is guided by guide rolls 16, 16A. The initial drying cylinders 10 in the multi-cylinder dryer 60 are arranged in a vertical stack and are followed by drying cylinders 10A which form a horizontal row. A guide roll 16A for wire 15 is situated between the last drying cylinders 10A. The interior of the last suction cylinder 30A is also preferably maintained at a negative pressure in accordance with the invention. The dried web $W_{out}$ passes from the last cylinders to a reel-up (not shown). The drying cylinders are each provided with doctors, designated 59.

Obviously, numerous modifications and variations of the present invention are possible in light of the above teachings. It is therefore to be understood that within the scope of the claims appended hereto, the invention may be practiced otherwise than as specifically disclosed herein.

What is claimed is:

1. A method for use in web drying apparatus of a paper machine which includes drying cylinders against the outer mantles of which a web to be dried is pressed in direct contact and wherein the web is carried from one drying cylinder to the next over a substantially straight run supported on a wire which passes from said one drying cylinder over an intermediate leading cylinder with the web being on the outer side of the wire out of direct contact with an outer mantle of said leading cylinder, and then to said next drying cylinder, and so that the web is situated on an outer surface of said wire when said wire runs over said intermediate leading cylinder, comprising the steps of:

providing said leading cylinder with a perforated outer mantle;

maintaining negative pressure in a pocket space defined between said pair of successive drying cylinders and the web-supporting wire by means for suctioning the web into contact with the wire as the web-supporting wire runs from said one drying cylinder to the intermediate leading cylinder to said next drying cylinder, said perforated mantle having a free sector not covered by said wire that normally opens in its entirety into the interior of said enclosed pocket chamber;

maintaining a negative pressure within the interior of said outer mantle of said leading cylinder for suctioning the web into contact with the wire as the wire travels over said leading cylinder, and arranging said outer mantle of said leading cylinder such that said perforations open into grooves which extend around the circumference of said outer mantle such that the area of said outer surface over which suction is effected is enlarged to an extent that the web remains substantially wrinkle-free and in a desirable drawing contact with the wire as the wire travels over the leading cylinder with the web carrier on its outer surface;

partially closing and sealing said free sector by sealing means such that a throttled flow of air flows from the interior of said enclosed pocket chamber into said interior of said leading cylinder; and removing air from said enclosed pocket space via air removal means comprising a blower connected to said pocket area by duct means and a damper means for adjusting the negative pressures within said pocket space, such that the negative pressure within said pocket space can be adjusted relative to the negative pressure within said leading cylinder;

wherein said negative pressure provided within said leading cylinder is greater than said negative pressure provided within said pocket space; and wherein said negative pressure provided within said leading cylinder is in a range of between about 3 to 9 times greater than the negative pressure provided in said pocket space.

2. The method of claim 1 wherein said negative pressure is provided within the interior of said outer mantle of said leading cylinder through at least one of its axial ends, and wherein said negative pressure is provided in said pocket space by drawing air from said pocket space through a free sector of said outer mantle of said leading cylinder that opens into said pocket space;

substantially enclosing said pocket space; and partially closing and sealing said free sector via sealing means such that a throttled flow of air flows from the interior of said pocket chamber into said leading cylinder and to such an extent that the negative pressures within said pocket space and within said leading cylinder can be adjusted relative to each other.

3. The method of claim 2 wherein said sector of said leading cylinder that opens into said pocket space is at least partially closed.

4. The method of claim 1 wherein said negative pressure in both said leading cylinder and said pocket space is provided by blower means communicating with the interior of said leading cylinder and said pocket space through duct means.

5. The method of claim 4 wherein said blower means comprises a first blower for providing said negative pressure in said leading cylinder, and a separate second blower for providing said negative pressure in said pocket space.

6. Drying apparatus for use in paper machines, comprising:

at least two drying cylinders arranged in successively adjacent relationship to each other;

at least one leading cylinder having a mantle provided with a plurality of perforations and an interior adapted to be connected to a source of suction, whereby said leading cylinder constitutes a suction cylinder, each leading cylinder situated intermediate of a respective pair of successive drying cylinders;

an endless wire for carrying a web from a first one of a pair of successive drying cylinders over a substantially straight run to said intermediate leading cylinder, and from said intermediate leading cylinder over a substantially straight run to a second one of said pair of successive drying cylinders, so that the web is pressed by said wire in direct contact with outer mantles of said drying cylinders, and so that the web is situated on an outer surface of said wire when said wire runs over said intermediate leading cylinder;

said straight runs of said wire between successive adjacent drying cylinders and a respective intermediate leading cylinder defining a pocket space together with the open section of said leading cylinder mantle;

means for substantially enclosing said pocket space;

means for providing a negative pressure in said pocket space for suctioning the web into contact with the wire on the substantially straight runs of said web-supporting wire between said drying cylinders and said leading cylinder; and means for providing a negative pressure within the interior of said leading cylinder for suctioning the web into contact with the wire as the wire travels over said leading cylinder, said mantle having an outer surface, said perforations in said mantle of said leading cylinder opening into grooves which extend around the circumference of said outer surface such that the area of said outer surface over which suction is effected is substantially enlarged to such an extent that the web remains substantially wrinkle-free and in a desirable drawing contact with said wire as said wire travels over said leading cylinder, said perforated mantle having a free sector not covered by said wire that normally opens in its entirety into the interior of said enclosed pocket chamber, said free sector being partially closed and sealed by sealing means such that a throttled flow of air flows from the interior of said enclosed pocket chamber into said interior of said leading cylinder, air removal for removing air from said enclosed pocket space, said air removal means allowing the negative pressure within said pocket space to be adjusted relative to the negative pressure within said leading cylinder, said air removal means comprising a blower connected to said pocket area by duct means, and a damper means for adjusting the negative pressures within said pocket space.

7. The apparatus of claim 6 wherein said apparatus comprises a plurality of drying cylinders arranged in a substantially horizontal row.

8. The apparatus of claim 6 wherein said apparatus comprises a plurality of drying cylinders arranged in a substantially vertical column.

9. The apparatus of claim 6 wherein said leading cylinder comprises a source of suction and duct means communicating said leading cylinder interior with said suction source, and wherein said means for providing a negative pressure in said pocket space includes said perforations through said open sector of said leading cylinder mantle forming a part of said pocket space.

10. The apparatus of claim 6 wherein said perforated mantle of said leading cylinder has circumferential grooves formed in its outer surface into which said perforations open.

11. The apparatus of claim 6 wherein said means for enclosing said pocket space comprise a pair of end plates, each end plate situated at a respective transverse end of said pocket space, and having opposed substantially straight edges spaced from respective straight runs of said web-supporting wire by small gaps, and a curved edge spaced from said free sector of said suction cylinder by a small gap.

12. The apparatus of claim 11 wherein said gaps are in the range of between about 5 to 15 millimeters.

13. The apparatus of claim 11 wherein said opposed substantially straight edges of said end plates extend substantially the entire length of said straight runs of said web-supporting wire, and wherein said means for enclosing said pocket space further includes wall means extending between said pair of successive drying cylinders.

14. The apparatus of claim 13 wherein said wall means include elastic seal plates cooperating with mantles of said drying cylinders.

15. The apparatus of claim 6 wherein said suction roll and said means for providing a negative pressure within the interior of said suction cylinder comprise separate suction ducts communicating with said pocket space and leading cylinder interior respectively,, blower means communicating with said suction ducts, and pressure regulator means for independently selectively adjusting the negative pressures in said leading cylinder interior and said pocket space.

16. The apparatus of claim 15 wherein said blower means comprise separate blowers provided in separate suction ducts.

17. The apparatus of claim 6 wherein said means for providing a negative pressure in said pocket space comprises a blow box arranged between said pair of successive adjacent drying cylinders, said blow box forming a part of said means for substantially enclosing said pocket space.

18. The apparatus of claim 17 wherein said blow box includes nozzle means situated proximate to a first one of said pair of successive drying cylinders for blowing jets of air in a direction substantially opposite to the direction of the first one of said pair of successive drying cylinders and the web-carrying wire travelling thereover, said air jets causing air to be ejected from said pocket space.

19. The apparatus of claim 6 wherein said negative pressure provided in at least one of said pocket space and leading cylinder interior varies in magnitude over the width of the web.

20. The apparatus of claim 6 wherein said negative pressure provided in at least one of said pocket space and leading cylinder interior extends only over a part of the width of the web.

21. The apparatus of claim 20 wherein said negative pressure extends only over lateral areas of the web.

22. The apparatus of claim 9, wherein said sealing means comprises a covering plate having edges situated at a small gap distance from said outer surface of said leading cylinder.

23. The apparatus of claim 9, wherein said sealing means comprises a closing chamber provided within said leading cylinder, said closing chamber including seal ribs that bear against a smooth inner surface of said mantle such that a closed sector is formed, the magnitude of said closed sector being chosen such that the negative pressures within said pocket space and within said leading cylinder can be adjusted relative to each other.

24. Drying apparatus for use in paper machines, comprising:

at least two drying cylinders arranged in successively adjacent relationship to each other;

at least one leading cylinder having a perforated mantle and an interior adapted to be connected to a source of suction, said leading cylinder situated intermediate of a respective pair of successive drying cylinders;

an endless wire for carrying a web from a first one of a pair of successive drying cylinders over a substantially straight run to said intermediate leading cylinder, and from said intermediate leading cylinder over a substantially straight run to a second one of said pair of successive drying cylinders, so that the web is pressed by said wire in direct contact with outer mantles of said drying cylinders, and so that the web is situated on an outer surface of said wire when said wire runs over said intermediate leading cylinder;

said straight runs of said wire between successive adjacent drying cylinders and said intermediate leading cylinder defining a pocket space together with the open section of said leading cylinder mantle, said pocket space between said at least two drying cylinders being substantially enclosed by a chamber-like structure defined by a wall situated in the space between said at least two drying cylinders, a pair of end plates situated at respective traverse ends of said pocket space and having opposed substantially straight edges spaced from respective straight runs of said web-supported wire by small gaps;

means for providing a negative pressure in said pocket space for suctioning the web into contact with the wire on the substantially straight runs of said web-supporting wire between said drying cylinders and said leading cylinder;

means for providing a negative pressure within the interior of said leading cylinder for suctioning the web into contact with the wire as the wire travels over said leading cylinder, said perforations in said mantle of said leading cylinder opening into grooves which extend around the circumference of said outer surface;

said perforated mantle having a free sector not covered by said wire, said free sector opening into the interior of said pocket chamber, said free sector being partially closed and sealed by sealing means such that a throttled flow of air flows from the interior of said pocket chamber into said interior of said leading cylinder thereby providing a desired magnitude of said negative pressures within said pocket chamber and within said interior of said leading cylinder; and air removal for removing air from said enclosed pocket space, said air removal means allowing the negative pressure within said pocket space to be adjusted relative to the negative pressure within said leading cylinder, said air removal means comprising a blower connected to said pocket area by duct means, and a damper means for adjusting the negative pressures within said pocket space.

25. The apparatus of claim 24, wherein said sealing means comprises a covering plate having edges situated at a small gap distance from said outer surface of said leading cylinder.

26. The apparatus of claim 24, wherein said sealing means comprises a closing chamber provided within said leading cylinder, said closing chamber including seal ribs that bear against a smooth inner surface of said mantle such that a closed sector is formed, the magnitude of said closed sector being chosen such that the negative pressures within said pocket space and within said leading cylinder can be adjusted relative to each other.

27. The apparatus of claim 24, wherein said perforations in said leading cylinder open into grooves which extend around the circumference of said outer surface such that the area of said outer surface over which suction is effected is enlarged to an extent that the web remains substantially wrinkle-free and in a desirable drawing contact with the wire as the wire travels over said leading cylinder with the web carried on its outer face.

28. The apparatus of claim 24, further comprising air removal means for removing air from said enclosed pocket space, said air removal means allowing the negative pressure within said pocket space to be adjusted relative to the negative pressure within said leading cylinder.

29. The apparatus of claim 28, wherein said air removal means comprises a blower connected to said pocket area by duct means, and a damper means for adjusting the negative pressures within said pocket space.

30. Drying apparatus for use in web coating machines, comprising:

at least two drying cylinders arranged in successively adjacent relationship to each other;

at least one leading cylinder having a perforated mantle and an interior adapted to be connected to a source of suction; said leading cylinder situated intermediate of a respective pair of successive drying cylinders;

an endless wire for carrying a web from a first one of a pair of successive drying cylinders over a substantially straight run to said intermediate leading cylinder, and from said intermediate leading cylinder over a substantially straight run to a second one of said pair of successive drying cylinders, so that the web is presented by said wire in direct contact with outer mantles of said drying cylinders, and so that the web is situated on an outer surface of said wire when said wire runs over said intermediate leading cylinder;

said straight runs of said wire between successive adjacent drying cylinders and said intermediate leading cylinder defining pocket space together with the open sector of said leading cylinder mantle, said pocket space between said at least two drying cylinders being substantially enclosed by a chamber-like structure defined by a wall situated in the space between said at least two drying cylinders, a pair of end plates situated at respective traverse ends of said pocket space and having opposed substantially straight edges spaced from respective straight runs of said web-supported wire by small gaps;

said wall provided with sealing means to substantially enclose said pocket space in conjunction with said pair of end plates and said free sector of said leading cylinder;

means for providing a negative pressure in said pocket space for suctioning the web into contact with the wire on the substantially straight runs of said web-supporting wire between said drying cylinders and said leading cylinder; and means for providing a negative pressure within the interior of said leading cylinder for suctioning the web into contact with the wire as the wire travels over said leading cylinder;

said means for providing a negative pressure within said pocket space and means for providing a negative pressure within the interior of said leading cylinder comprises a blower connected by a first duct means to said pocket space and by a second duct means to said interior of said leading cylinder, and dampers provided on said first duct means and said second duct means, such that regulation of said blower by said dampers causes the pressure levels within said pocket space and said interior of said leading cylinder to be adjusted both independently with respect to their magnitudes and with respect to each other.

31. The apparatus of claim 30, wherein said perforations in said leading cylinder open into grooves which extend around the circumference of said outer surface such that the area of said outer surface over which suction is effected is enlarged to an extent that the web remains substantially wrinkle-free and in a desirable drawing contact with the wire as the wire travels over said leading cylinder with the web carried on its outer face.

32. The apparatus of claim 30, wherein said perforated mantle has a free sector not covered by said wire, said free sector opening into the interior of said pocket chamber, said free sector being partially closed and sealed by sealing means such that a throttled flow of air flows from the interior of said pocket chamber into said interior of said leading cylinder and thereby providing a desired magnitude of said negative pressures within said pocket chamber and within said interior of said leading cylinder.

* * * * *